United States Patent [19]

Montgomery

[11] 4,348,971

[45] Sep. 14, 1982

[54] MULTI-HULL BOATS

[75] Inventor: Jon A. Montgomery, Teddington, England

[73] Assignee: Roger Derek Morrison-Jones, Waterloo, Belgium; a part interest

[21] Appl. No.: 892,094

[22] Filed: Mar. 30, 1978

[30] Foreign Application Priority Data

Apr. 4, 1977 [GB] United Kingdom ..... 14196/77

[51] Int. Cl.[3] ..... B63B 7/08

[52] U.S. Cl. ..... 114/61; 114/39; 114/345

[58] Field of Search ..... 114/39, 61, 283, 292; 9/2 R, 2 A, 11 A, 11 R, 2 C; 16/128 R

[56] References Cited

U.S. PATENT DOCUMENTS

| | | | |
|---|---|---|---|
| 1,093,196 | 4/1914 | Lombardi | 115/22 |
| 2,351,542 | 6/1944 | Paull | 114/39 |
| 2,712,293 | 7/1955 | O'Higgins | 114/61 |
| 3,473,502 | 10/1969 | Wittkamp | 114/61 X |
| 3,510,906 | 5/1970 | Baldwin, Sr. | 16/128 R |
| 3,566,425 | 3/1971 | Welty | 9/2 A |
| 3,696,451 | 10/1972 | Thompson | 9/2 A |
| 3,866,557 | 2/1975 | Lang | 114/61 |
| 4,136,414 | 1/1979 | Popkin | 114/61 X |

FOREIGN PATENT DOCUMENTS

| | | | |
|---|---|---|---|
| 180860 | 1/1955 | Austria | 9/2 A |
| 1035755 | 8/1953 | France | 9/11 A |
| 1482860 | 1/1966 | France | 114/39 |
| 1508523 | 1/1967 | France | 9/2 R |
| 7508090 | 1/1977 | Netherlands | 114/61 |

*Primary Examiner*—Sherman D. Basinger

*Attorney, Agent, or Firm*—Blanchard, Flynn, Thiel, Boutell & Tanis

[57] ABSTRACT

An inflatable catamaran comprises a central tubular longitudinal torsion beam carrying a mast and a set of four or five cross beams secured at their centers to the longitudinal torsion beam and at their outer ends to a pair of inflatable hulls. Each hull has an upper inflatable tube and a lower inflatable tube tightly held together by side walls.

5 Claims, 14 Drawing Figures

MULTI-HULL BOATS

The present invention relates to multi-hull boats having inflatable hulls and more particularly but not exclusively to inflatable catamarans.

Inflatable catamarans have been proposed for example in French Patent Specification No. 401,340 and its Certificates of Addition Nos. 11707 and 16361 and French Patent Specifications Nos. 1,135,639 and 1,508,523 all of which show a pair of inflatable hulls interconnected by a structure which extends substantially uniformly across the width in between the hulls.

According to the present invention there is provided a multi-hull boat comprising a pair of inflatable hulls interconnected by a central structure, wherein the central structure comprises a central longitudinal torsion beam to which are rigidly secured hull connecting beams extending outwards from the central torsion beam to at least three spaced attachment points on each hull.

With this arrangement, the torsional stiffness of the longitudinal beam can be made sufficient to take up the twisting moments exerted by the boat when encountering strong winds and waves while the vertical strength of the beam can easily take the massive vertical loads exerted by a mast and its forestay, while the hull connecting beams can be anchored to the hulls at intervals along the lengths of the hulls in positions above the water level, in such a manner as to avoid imposing excessive loads at any one anchorage point between the hull connecting beams and the hulls. Preferably both the longitudinal torsion beam and the hull connecting beams are tubular, the latter being transverse to the former and extending the full width from one hull to the other hull.

U.S. Pat. No. 2,712,293 discloses a structure for interconnecting two rigid hulls comprising a torsionally flexible elongated plate (termed a beam) which is connected to the two hulls at each end of the plate by cross members. The rigid hulls absorb most of the torsional couples exerted on the structure, but such an arrangement is clearly not suitable where the hulls are inflatable and therefore inherently somewhat flexible.

Preferably, the inflatable hulls in accordance with the invention comprise an upper inflatable tube, a lower inflatable tube and a pair of side walls interconnecting the upper and lower tubes, the heights of the free portion of the side walls extending between the tubes being small enough to deform the tubes when inflated thereby to hold the side walls in tension. With this arrangement, the hull can have a height which is greater than its width while at the same time being much stiffer in the vertical plane as compared with either a single inflatable tube or a pair of relatively movable superimposed tubes as disclosed in French Specification No. 1,508,523 referred to above.

Preferably, the bow portions of the two tubes taper substantially down to a point and are spaced apart by a spacing element, the side walls being continued forwardly to cover the spacing element and produce a substantially conventional sharp bow.

The invention will now be further described by way of example with reference to the accompanying drawings, in which.

Figure 2:
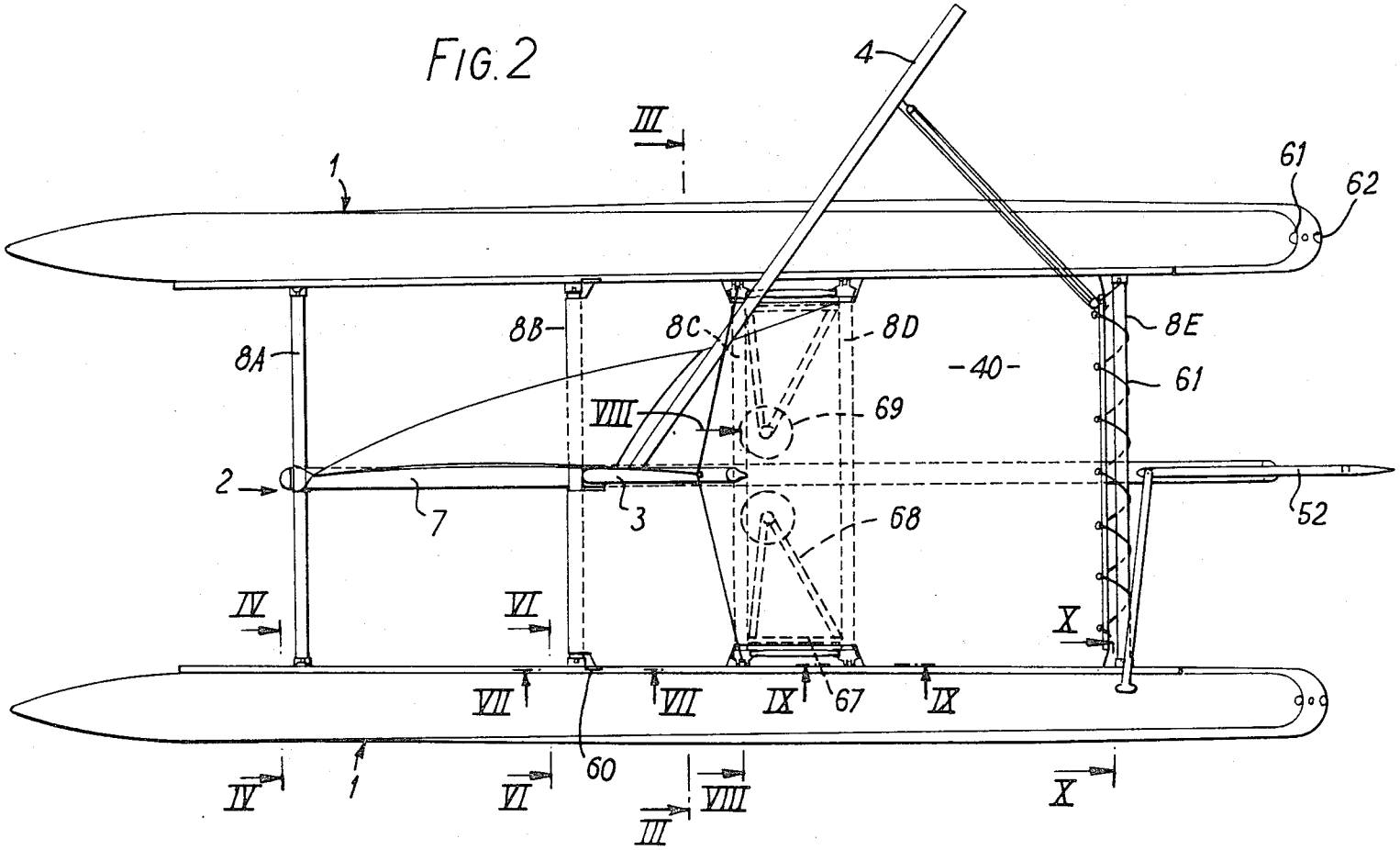
FIG. 2 is a plan view of the catamaran shown in FIG. 1.
Figure 3:
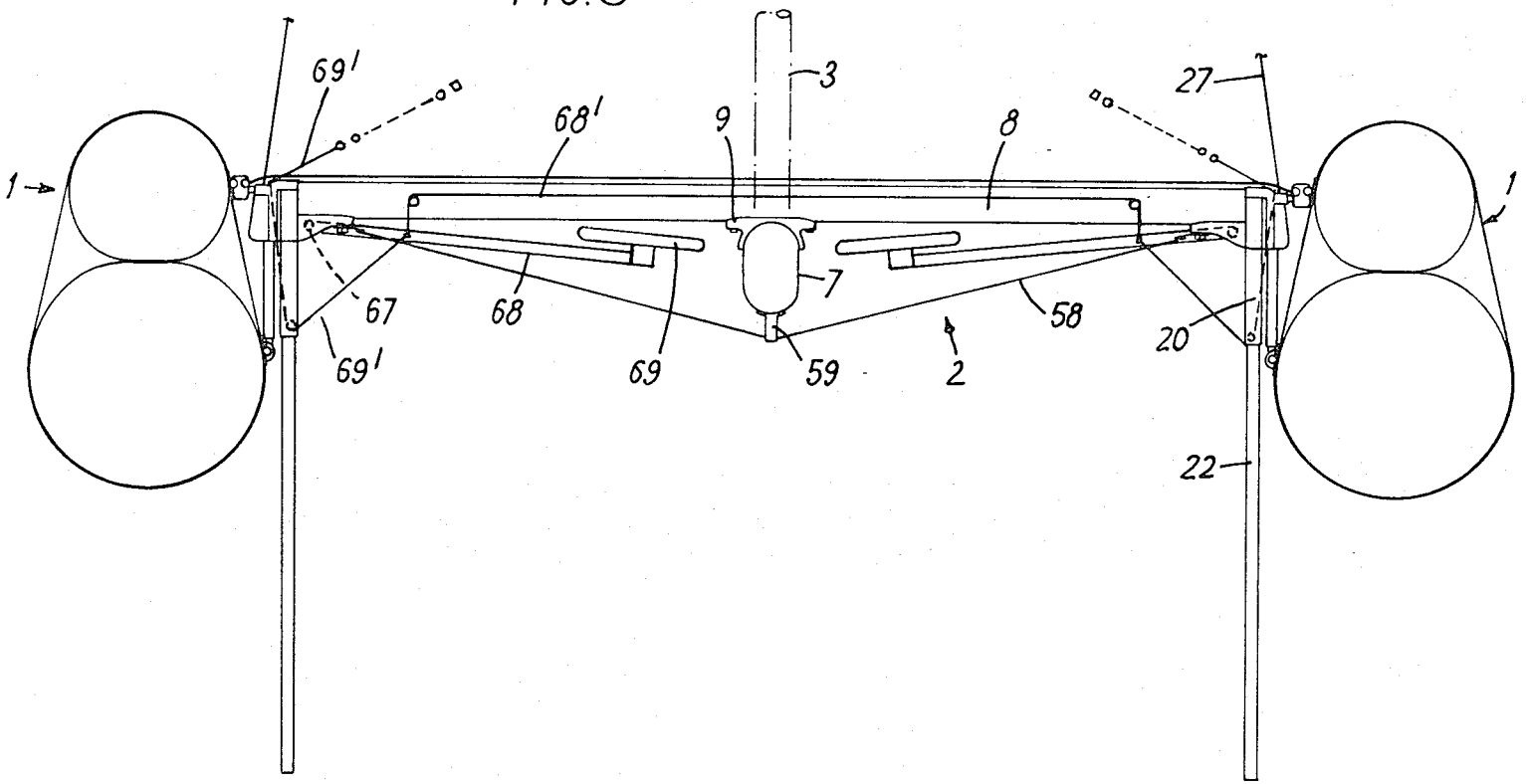
Figure 4:
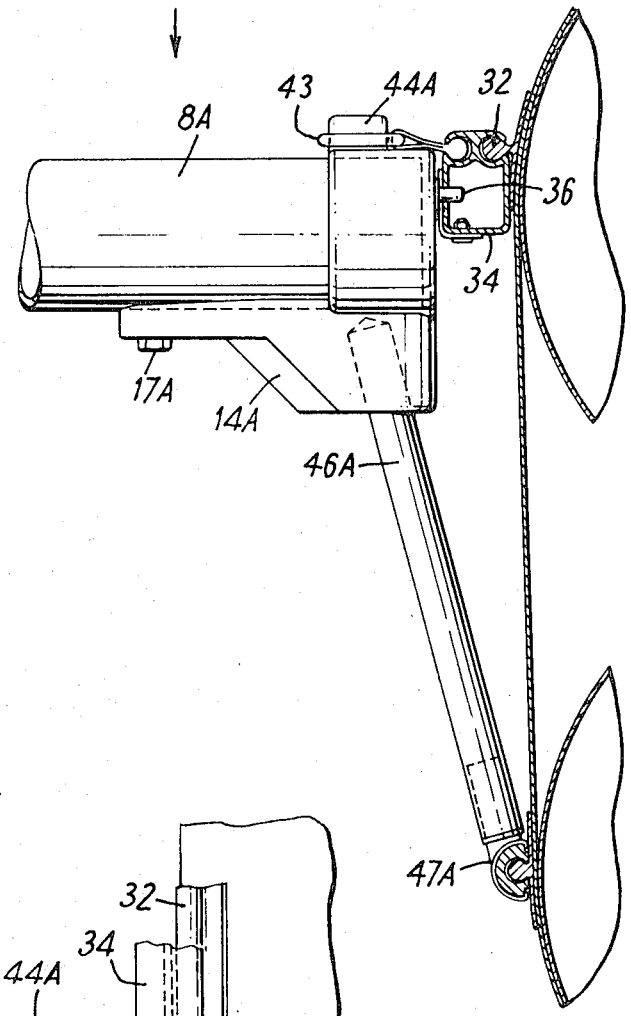
Figure 5:
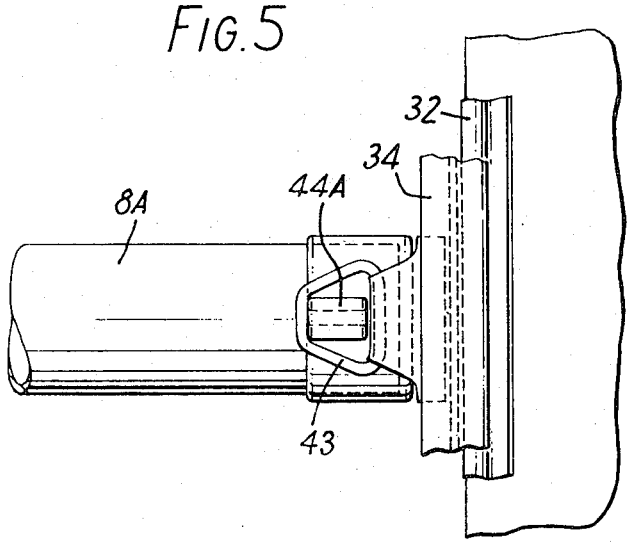
Figure 6:
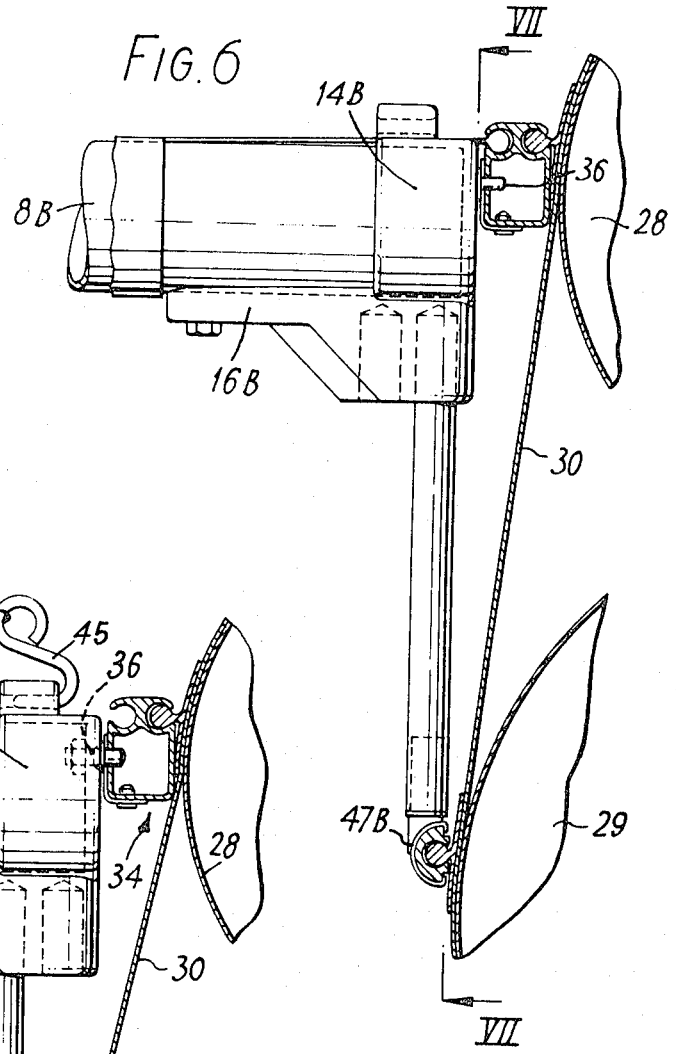
Figure 10:
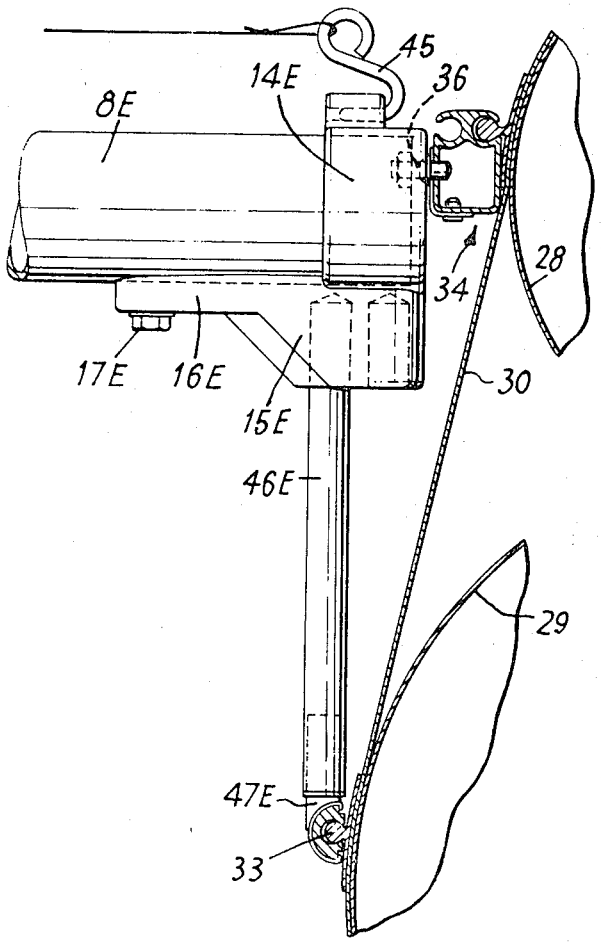
Figure 7:
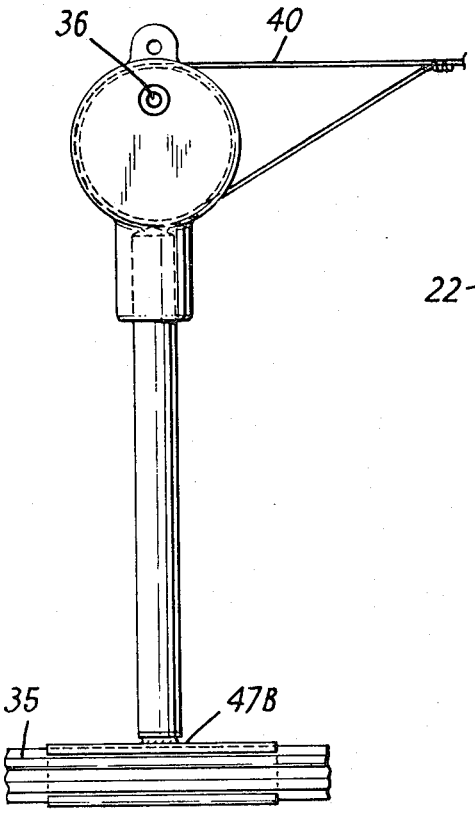
Figure 9:
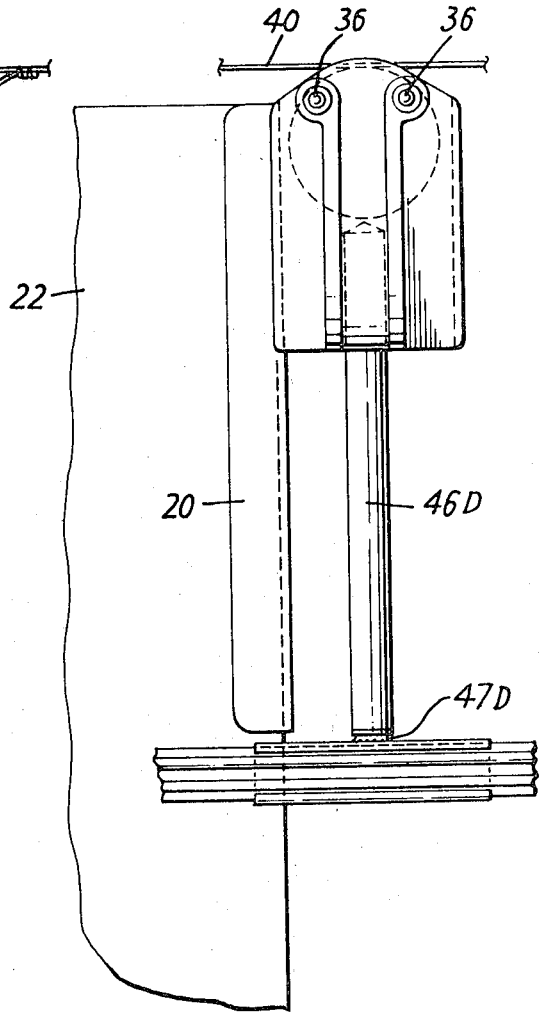
Figure 8:
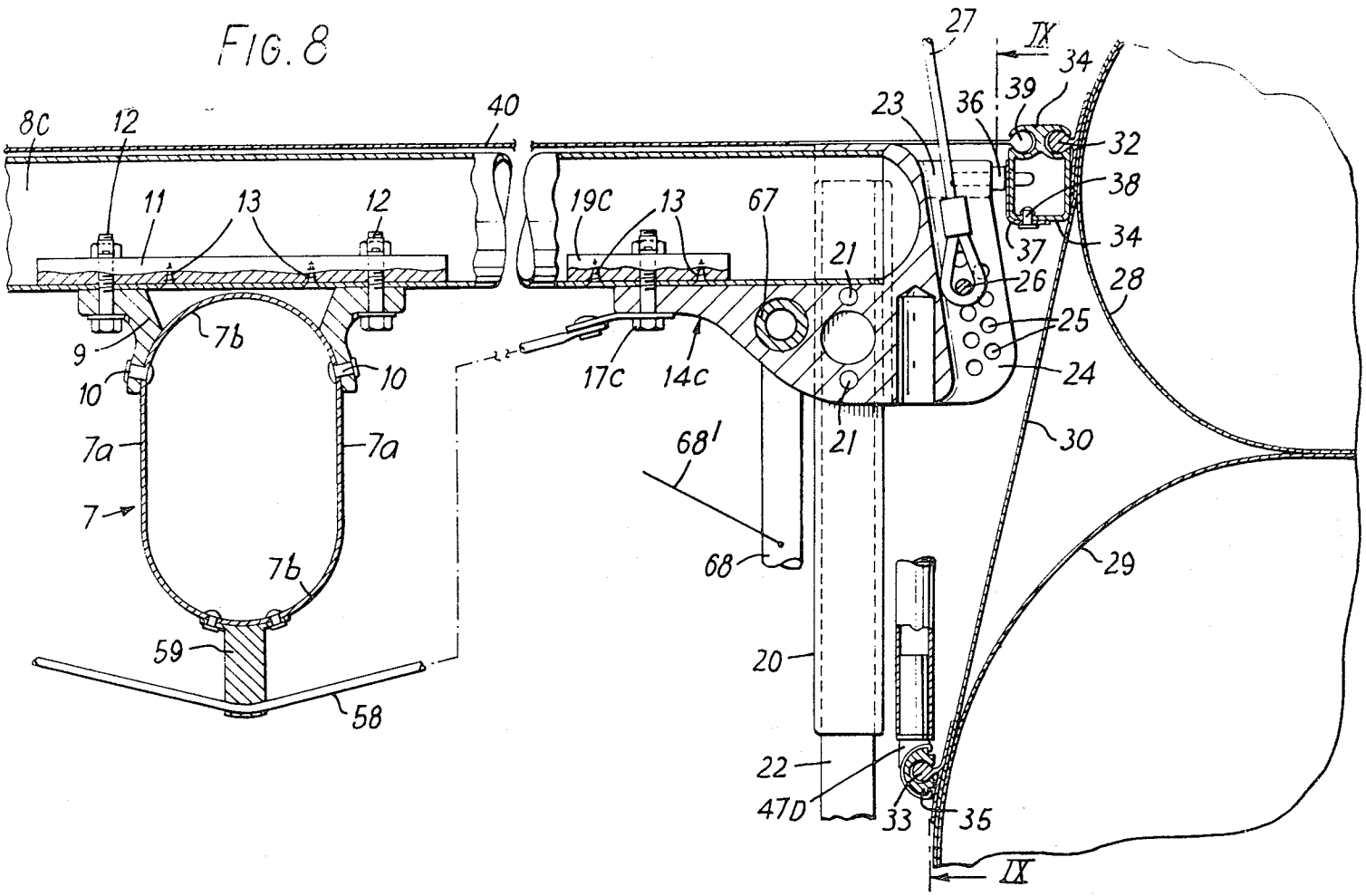
Figure 11:
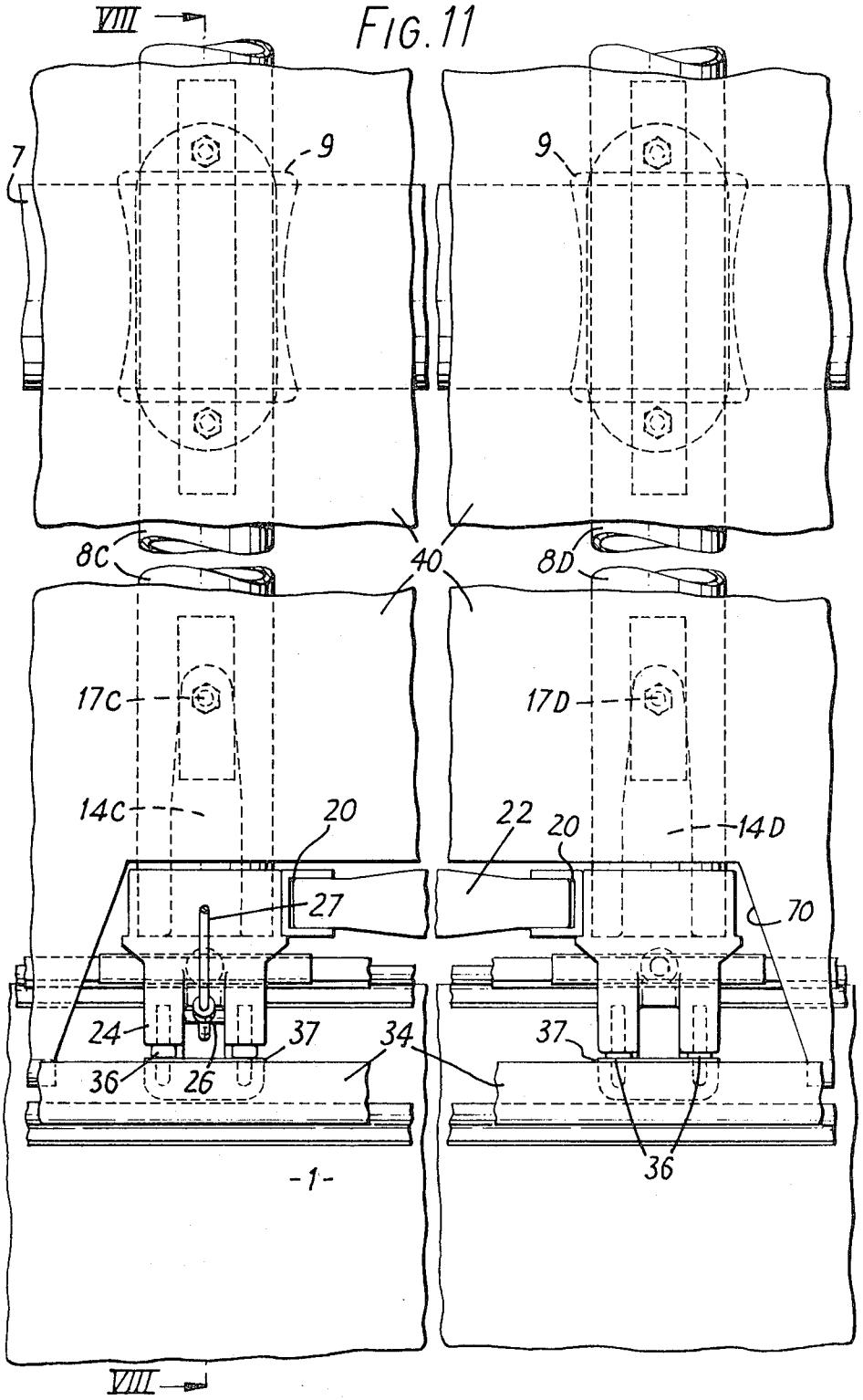

FIG. 3 is a schematic cross-sectional view on the line III.III of FIG. 2 on an enlarged scale, FIGS. 4, 6,8 and 10 are cross-sectional views on a greatly enlarged scale on the lines IV—IV, VI—VI, VIII—VIII and X—X respectively of FIG. 2, FIG. 5 is a plan view in the direction of the arrow V in FIG. 4, FIGS. 7 and 9 are elevational views on the lines VII—VII and IX—IX respectively of FIGS. 6 and 8 and of FIGS. 2 and 11, with the hulls removed.

Figure 12:
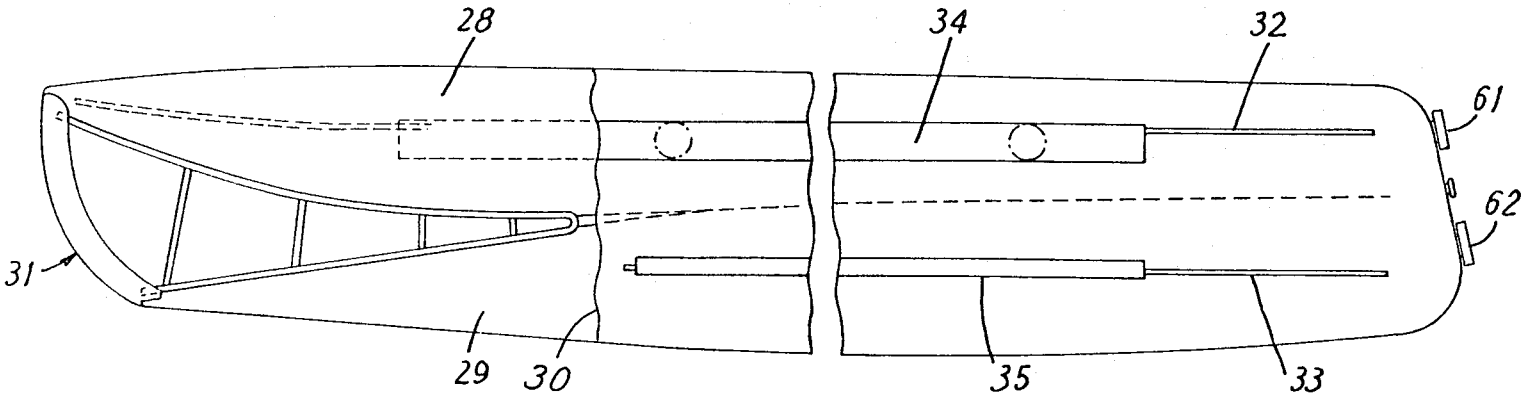
Figures 13, 14:
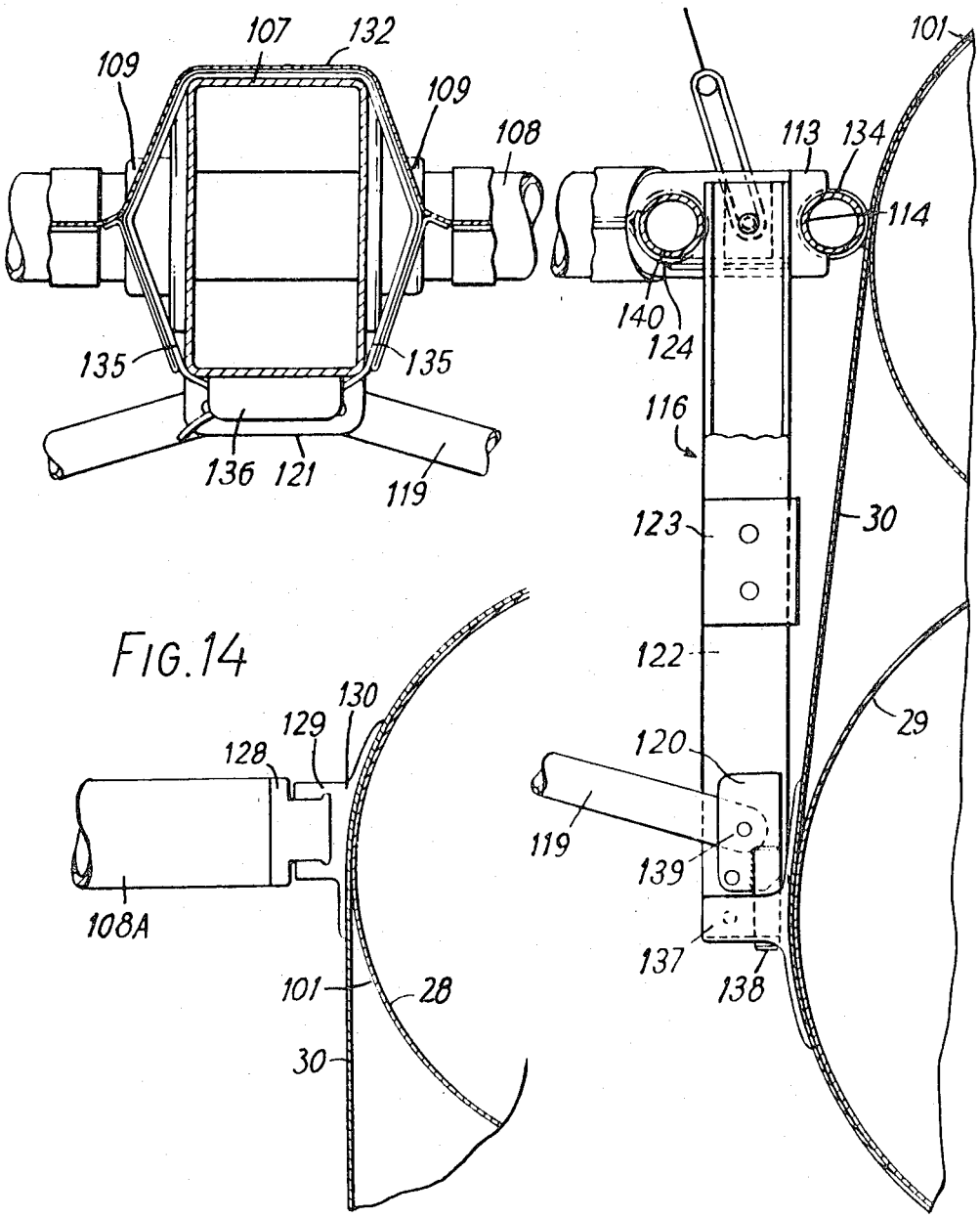

FIG. 11 shows a portion of FIG. 2 in the neighbourhood of the lines VIII—VIII and IX—IX on a greatly enlarged scale, FIG. 12 shows an elevational view of the forward and aft ends of a hull, partly in section, of the catamaran, and FIGS. 13 and 14 are views similar to FIGS. 8 and 4 respectively showing alternative constructional details.

The catamaran shown in FIGS. 1 to 12 comprises (FIGS. 1 to 3) a pair of spaced inflatable hulls 1, a central structure 2 interconnecting the hulls 1 and a mast 3 mounted on the central structure 2 and carrying a boom 4, a mainsail 5 and a jib 6.

The central structure 2 comprises a tubular portion beam 7 on aluminium or aluminium alloy tubing which in cross-section (FIG. 8) has two flat side faces 7A which are joined top and bottom by semi-circular portions 7B. This formation gives the torsion beam 7 both great strength against bending in the vertical plane and against twisting about the longitudinal axis of the beam 7. In addition, the central structure 2 includes a set of five tubular cross beams 8A, 8B, 8C, 8D and 8E which are formed of circular-section aluminium or aluminium alloy tubing and are secured at intervals along the top of the beam 7 at their mid-points. For this purpose, the top curved portions *7b* of the beam 7 carries saddle castings 9, one at the required location of each cross beam 8. Each saddle casting 9 is bonded by adhesive to the beam 7 and is further secured thereto by pop-rivets 10. The upper surface of each saddle casting 9 is formed with a cylindrically curved seating to receive the cross beam 8. Inside the latter is an insert 11 formed with screw-threaded holes or bushes to receive the shanks of bolts or screws 12 by means of which the cross beam can be securely clamped to the saddle casting 9 and thus secured to the beam 7. The inserts 11 are held securely in position against accidental displacement during handling, assembly and disassembly by means of set screws 13.

Shake-proof or spring washers will normally be positioned under the heads of the bolts or screws 12 to prevent the latter loosening in service.

Each end of the cross beam 8 engages in a socket formed in a respective aluminium or aluminium alloy casting 14. Each of the castings 14A, 14B and 14E is made to the same pattern and, in addition to the socket portion has a lower boss portion 15 from which a lug 16 projects inwards along the underside of the associated cross beam 8. A bolt or screw 17 passes upwards through the lug 16 and through a hole in the tube 8 into an insert 19 inside the latter, of similar construction to one half of the insert 11, the insert 19 being secured by a pair of set screws 13. Although made to a different pattern, the castings 14C and 14D (FIGS. 8, 9 and 11) are generally similar to the other castings 14 in the manner in which they fit over the ends of the cross beams 8C and 8D and are secured to the latter by bolts 17 and inserts 19. A dagger board guide channel 20 is bolted at 21 to adjacent side faces of each of the castings 14C and 14D to guide a pair of dagger boards 22 for vertical movement one adjacent each of the hulls 1. Moreover, the outer face of each of the castings 14C and 14D is formed with an upwardly sloping channel 23 formed between two check portions 24 of the castings. As shown in FIG. 8, the check portions 24 are drilled with a number of aligned holes 25 so that an anchor pin 27 for a mast shroud 27 can be suitably positioned through one of the pair of aligned holes 25.

In order to stiffen the cross beam 8C against the vertical loads exerted on it by the shroud 27, a strainer cable 58 is run, under tension, between the two bolts 17C and lies in a groove in a spacer member 59 carried by the lower curved face 7B of the torsion beam 7.

Each inflatable hull 1 comprises an upper inflatable tube 28, a lower inflatable tube 29 and side walls 30 which interconnect the tubes 28 and 29 in such a manner that when the latter are inflated, the side walls 30 are held under tension while at the same time the tubes 28 and 29 are somewhat flattened as the result of the tension in the side walls 30. The tubes 28 and 29 and the side walls 30 may be made of flexible PVC sheet or of fabric impregnated with rubber for example. At their forward ends the tubes 28 and 29 taper down to form nose portions as can be seen in plan in FIG. 2. These nose portions are spaced apart from each other by vertical spacers which may be made of plywood although preferably they are formed by light metal or plastic frames as shown at 31 in FIG. 12, the nose portions of the tubes 28 and 29 and the frame 31 being covered by the side walls 30.

Extending along the inner face of each hull 1 is a pair of spaced horizontal beads 32 and 33 which each in cross-section has the form of a major portion of a circle. Upper and lower link members 34 and 35 of extruded aluminium or aluminium alloy each have a respective channel which is substantially complementary to the respective bead 32,33 so that it can be slid along the bead while holding the bead captive in the channel.

Each of the castings 14 carries a shouldered pin 36, the smaller diameter portion of which can engage in a hole provided for it in the inner side wall of the upper link member 34. Preferably, a stainless steel sheet reinforcement 37 is riveted to the upper link member 34 at 38 to prevent enlargement of these holes in use. Above the level of the shouldered locating pins 36, the inner side face of the link member 34 has a second channel of section which is also in the form of a major arc of a circle to receive an enlarged bead 39 along the outer edge of a trampoline deck 40 which thereby serves to hold the link members 34 in firm contact with the shoulders on the pins 36.

The forward end of the trampoline deck 40 is secured around the cross member 8B while its aft edge is laced to the aft most cross member 8E. Since the trampoline deck does not extend forwards to the cross member 8A, a buckle or loop 43 (FIGS. 4 and 5) is secured to the link member 34, conveniently in the channel provided for the trampoline deck, and engages over a projection 44A on the top of the casting 14A.

Thus, the upper portions of the hulls 1 are securely fixed to the central structure 2. In order to keep the lower portions of the hulls 1 in the required positions, despite the forces exerted on the inherently flexible hulls as the result of movement across the water at high speed, each of the castings, with the exception of the castings 14C carries a downwardly extending tube 46, again of aluminium or aluminium alloy, the upper end of which is engaged in a bore drilled in the boss 15 of the respective casting while its lower end receives the shank of a T-shaped anchor member 47, the head of which is formed with a groove or channel to engage slidably but firmly on the lower link member 35. As can be seen from comparison of FIGS. 4, 6, 8 and 10, the angles which the posts 46 make to the respective cross members 8 can vary along the length of the hull in order to accommodate desired variations in the cross-section of the hull.

As can be seen in FIGS. 9 and 11, the castings 14C and 14D each carry a pair of horizontally spaced shoulder pins 36 which, by engagement with the upper link member 34, help to ensure that the dagger board guides 20 are maintained parallel. For the other castings 14A, 14B and 14E, a single shoulder locating pin 36 is sufficient. It will be noted that the standard pattern casting for these three castings can still be used despite changes in the angle of the post 46, since all that is needed to accommodate these varying angles is the drilling of the bores at the appropriate positions and angles to receive the respective posts 46.

As shown in FIG. 10, each of the castings 14E on the aft most cross member 8E has its top projection 44E drilled to receive a hook 45 for an anchorage cross line for the main sheet of the boom 4.

As can be seen in FIG. 8, the castings 14C and 14D are formed with additional bores 66 to receive a tube 67 carrying a tubular leg 68 carrying a wheel 69 at its lower end. When the leg is in its downwardly extended position, the wheels project below the underside of the hulls 1 to engage the ground or beach to facilitate manhandling of the catamaran on dry ground. The tubular legs 68 are retracted by an elastic cord 68′ swinging them upwards about the tubes 67 which acts as pivots and the legs and wheel can be lowered by pulling on handles attached to cords 69′ attached to the legs 68.

The mast 3 can be sectional, being conveniently formed in two sections and being of the hollow metal type forming a passage for halyards for hoisting the mainsail 5 and foresail 6. In addition to the stays 27, a forestay 51 for the mast can be secured to the leading end of the beam 7. A rudder 52 is pivoted to the aft end of the beam 7 and carries a tiller arm 53.

When the catamaran shown in FIGS. 1 to 12 is dismantled, the two hulls 1 are deflated and can be folded up into a comparatively small space and stowed together with the sails, trampoline deck 40, dagger boards 22, posts 46 (carrying the castings 14) and the rudder in the boot of a normal car while the beam 7 can be mounted on a roof-rack together with a cross-members and boom, the sections of the mast being separated (but still interconnected by the halyards).

Assembly of the catamaran merely involves assembling the cross beam or members 8 to the torsion beam 7 by offering up the cross members 8 to their respective saddle castings 9 and inserting and tightening the bolts or screws 12. The castings 14 carrying their respective posts 46 are engaged over the ends of the cross members 8 and secured by their screws or bolts 17 (the ends of the stay 58 being clamped under the heads of the bolts 17C and the ends of the tube 47 being inserted in their bores in the castings 14C and 14D).

Figure 1:
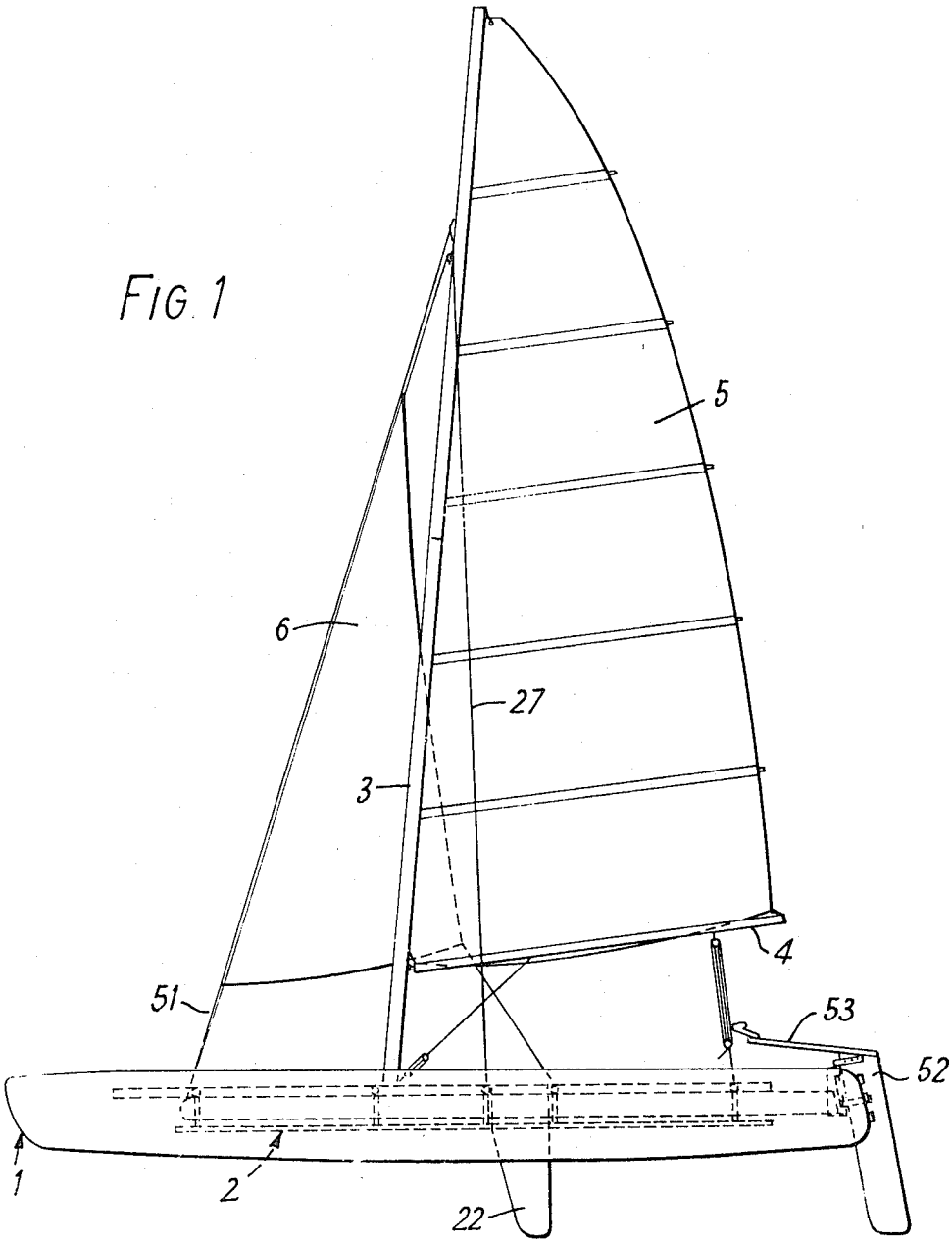
FIG. 1 is a side elevational view of the catamaran in its assembled form.

The upper and lower tubes 28 and 29 of the hulls 1 are partially inflated (through appropriate valves 61 and 62)

and the link members 34 and 35 are engaged with and slid along the ribs 32 and 33 into the required positions. The T-shaped anchor members 47 are then slid along the lower link member 35 into their required positions and, with the hulls upright and at the appropriate spacing apart, the assembled central structure 2 is lowered to engage the shanks of the anchor members 47 in the lower ends of the tubular posts 46 and thereafter to engage the pins 36 with their holes in the upper link member 34. Thereafter, the trampoline deck 40 which, as shown in the drawings preferably has its leading end secured to the cross member 8B, has its aft edges introduced into the channels in the upper link members 34 through a gap formed in the upper walls of the latter at 60 (FIGS. 1 and 12). The two aft corners of the trampoline deck are then pulled aftwards, thereby drawing the two lateral edges of the deck 40 along the channels until the aft edge reaches the position shown in FIG. 2 where it is secured to the aft most cross member 8E by lacing 61. As can be seen from FIG. 2 the geometry of the catamaran is such that the width of the trampoline deck increases slightly but progressively from front to rear so that tightening of the lacing 61 also tightens the deck 40 laterally.

The hulls are next fully inflated and the mast 3 assembled, stepped on the beam 7 and its stays 27 and 51 installed and tightened. The rudder, boom, dagger boards and sails can now be installed and the catamaran is ready for launching. As explained above, it can if desired be moved to a suitable launching site on the wheels which are then retracted.

The catamaran shown in FIGS. 1 to 12 has an overall length of approximately 4.8 meters and width of about 2 meters and can for example carry about 10 sq. meters of sail area.

FIGS. 13 and 14 show a variety of detailed modifications which may be applied simultaneously or individually to the catamaran shown in FIGS. 1 to 12. In particular, there are shown in FIGS. 13 and 14 a central beam 107 of rectangular cross-section with the cross members 108 passing through aligned apertures in the beam, these apertures being preferably thickened by collars 109 which are either separately formed or formed by continuous thickening of the side walls when the beam is formed as an extrusion. At its outer ends, each of the cross members 108 except the foremost (108A FIG. 14) carries an end member 113 with a part cylindrical recess to receive a link member in the form a hollow tubular skewer 114 which passes through a series of loops of fabric secured alternately to the hull structure 101 and the trampoline deck 132. The latter may be tightened around the central beam 107 by means of straps 135 and buckles 136.

The lower ends of the side posts may be secured to the lower portions of the hulls 1 by means of a peg 138, for example, of stainless steel welded to a plate 120 carried by the posts 122 which as shown in FIG. 13 may be formed by the guide channels for the dagger boards, being thus part of a dagger box assembly 116 which may include a horizontal brace 123. For further stiffness, struts 119 may interconnect a plate 121 on the underside of the beam 107 with bolts 139 passing through the plates 120. The pins 138 are engaged in blocks 137 of rubber fixed to the outside of the hulls 101.

If it is required to fix the edges of the trampoline deck where they are cut back to permit the passage of the dagger boards (as at 70 in FIG. 11), the edge of the trampoline deck may be secured around a tube 140 which can be held in a bracket 124 fixed to the dagger box, side post 46 or cross members 8 or 108.

As shown in FIG. 14, a cross member which lies forwards (or aft) of the trampoline deck may be fixed to the hulls by means of an end fitting 128 having a dovetail connection 129 with a block of rubber 130 secured to the hull 101.

If desired an outboard motor can be mounted on the rear end of the central longitudinal beam 7 or 107 in the location of the rudder, the latter being removed when the outboard motor is steerable.

I claim:

1. A multi-hull boat comprising a pair of inflatable hulls interconnected by a central structure, wherein the central structure comprises a central longitudinal tubular torsion beam to which are rigidly secured hull connecting beams extending outwards from the central torsion beam to at least three spaced attachment points on each hull, each hull comprising an upper inflatable tube, a lower inflatable tube and a pair of side walls respectively located on opposite sides of the hull and each interconnecting the upper and lower tubes, said side walls as seen in cross section defining a pair of generally upstanding straight lines laterally spaced by said tubes with each line extending substantially tangent to both tubes on its respective side of the hull, such that said side walls, the upper surface of the upper tube and the lower surface of the lower tube enclose the hull and form a continuous smooth oval hull outer cross section, the heights of the free portion of the side walls extending between the tubes being small enough to partly vertically compress the tubes one against the other when inflated, thereby to hold the side walls in tension, wherein the bow end of each tube tapers off towards the bow substantially to a point to form a tapered nose portion, said tapered nose portions being spaced apart from each other by a vertical spacer wherein a said spacer is inserted between the tapered nose portions of the tubes, said nose portions of said tubes and said spacer being covered by the side walls wherein said side walls continue forward to cover said spacer and produce a substantially conventional sharp yet upstanding bow on the inflatable hull.

2. A multi-hull boat comprising a pair of inflatable hulls interconnected by a central structure, wherein the central structure comprises a central longitudinal tubular torsion beam to which are rigidly secured hull connecting beams extending outwards from the central torsion beam to at least three spaced attachment points on each hull, including a trampoline deck having each lateral edge secured to a respective hull, wherein a thickened bead on each longitudinal edge of the trampoline and an opposed bead extending along each hull are slidably and captively retained in oppositely facing channels in an elongate laterally interposed link member linking the respective hull to the opposed longitudinal edge of the trampoline deck.

3. A multi-hull boat according to claim 2, wherein the ends of the hull connecting beams have elements for detachably engaging in the link members.

4. An inflatable hull for a multiple hull boat comprising an upper inflatable tube, a lower inflatable tube and a pair of side walls interconnecting and disposed on opposite sides of the upper and lower tubes, the side walls forming with the top of the upper tube and the bottom of the lower tube a smooth oval outer hull cross section, the heights of the free portion of the side walls extending between the tubes being small enough to press together and thus deform the tubes when inflated and therewith to hold the side walls in tension, wherein the bow end of each tube tapers off towards the bow substantially to a point to form a tapered nose portion, said tapered nose portions being spaced apart from each other by a vertical spacer wherein a said spacer is inserted between the tapered nose portions of the tubes, said nose portions of said tubes and said spacer being covered by the side walls wherein said side walls continue forward to cover said spacer and produce a substantially conventional sharp yet upstanding bow on the inflatable hull.

5. A multi-hull boat according to claim 1 or 4, in which said spacer is made of plywood.

* * * * *